US005785025A

United States Patent [19]

Yoshiume et al.

[11] Patent Number: 5,785,025

[45] Date of Patent: Jul. 28, 1998

[54] FUEL SUPPLY FOR INTERNATIONAL COMBUSTION ENGINE

[75] Inventors: Naoki Yoshiume; Makoto Miwa; Shigenori Isomura, all of Kariya, Japan

[73] Assignee: Nippondenso Co., Ltd., Kariya, Japan

[21] Appl. No.: 928,401

[22] Filed: Sep. 12, 1997

Related U.S. Application Data

[63] Continuation of Ser. No. 660,938, Jun. 10, 1996, abandoned.

[30] Foreign Application Priority Data

Jun. 9, 1995 [JP] Japan ..... 7-142756

[51] Int. Cl.[6] ..... F02M 41/00; F02M 37/04

[52] U.S. Cl. ..... 123/497; 123/511; 123/458

[58] Field of Search ..... 123/497, 514, 123/509, 511, 457–8, 459

[56] References Cited

U.S. PATENT DOCUMENTS

| | | | |
|---|---|---|---|
| 4,884,545 | 12/1989 | Mathis | 123/497 |
| 5,085,193 | 2/1992 | Morikawa | 123/497 |
| 5,148,792 | 9/1992 | Tuckey | 123/497 |
| 5,195,494 | 3/1993 | Tuckey | 123/510 |
| 5,289,810 | 3/1994 | Bauer et al. | 123/510 |
| 5,361,742 | 11/1994 | Briggs et al. | 123/514 |
| 5,373,829 | 12/1994 | Schuers et al. | 123/510 |
| 5,379,741 | 1/1995 | Matysiewicz et al. | 123/497 |
| 5,398,655 | 3/1995 | Tuckey | 123/497 |
| 5,406,922 | 4/1995 | Tuckey | 123/497 |
| 5,469,829 | 11/1995 | Kleppner et al. | 123/510 |
| 5,546,911 | 8/1996 | Iwamoto et al. | 123/497 |

FOREIGN PATENT DOCUMENTS

| | | |
|---|---|---|
| 62-32228 | 2/1987 | Japan . |
| 6-50230 | 2/1994 | Japan . |
| 6-272632 | 9/1994 | Japan . |

*Primary Examiner*—Thomas N. Moulis
*Attorney, Agent, or Firm*—Cushman Darby & Cushman IP Group of Pillsbury Madison & Sutro LLP

[57] ABSTRACT

In a fuel supply system employing a returnless fuel pipe arrangement, a relief valve is provided at a discharge side of a fuel pump. The relief valve is opened when fuel pressure in the fuel pipe arrangement becomes no less than a system protective pressure, so as to relieve the fuel pressure to protect the system. The relief valve is also arranged to be open when the fuel pressure in the fuel pipe arrangement becomes higher than a target fuel pressure by a predetermined value or when the fuel cut is performed. Thus, the fuel pressure in the fuel pipe arrangement is lowered. Thereafter, when the fuel pressure in the fuel pipe arrangement is lowered to a pressure near the target fuel pressure, the relief valve is arranged to be closed so that the fuel pressure in the fuel pipe arrangement is held substantially at the target fuel pressure.

8 Claims, 8 Drawing Sheets

FUEL FILTER
AIR CLEANER
AFM
DC-DC CONVERTER
I/O F
CPU
ROM
RAM
I/O F
INTAKE TEMP. SENSOR
WATER TEMP. SENSOR
SPEED SENSOR
11
12
13
14
15
16
17
18
19
20
21
22
23
24
25
26
27
28
29
34
35
36
37
38
39
40
41
42
45
50

FUEL SUPPLY FOR INTERNATIONAL COMBUSTION ENGINE

This is a continuation of application Ser. No. 08/660,938, filed on Jun. 10, 1996, which was abandoned upon filing hereof.

BACKGROUND OF THE INVENTION

1. Field of the Invention

The present invention relates to a fuel supply system for an internal combustion engine, wherein fuel pressure in the fuel piping or fuel pipe arrangement is controlled by controlling the speed or discharge pressure of a fuel pump.

2. Description of the Prior Art

Returnless piping structure has been proposed for simplifying the fuel pipe arrangement and lowering the fuel temperature in a fuel tank to prevent vapor formation therein. The returnless piping structure eliminates a fuel return line for returning an excessive portion of fuel, which is delivered under pressure from a fuel pump to fuel injectors (fuel injection valves), to the fuel tank. U.S. Pat. No. 5,148,792 discloses a fuel supply system employing the returnless piping structure or returnless pipe arrangement, wherein the speed (discharge pressure) of a fuel pump is feedback controlled depending on fuel pressure detected by a fuel pressure sensor provided in the fuel pipe arrangement.

On the other hand, in a fuel supply system with a fuel pipe arrangement including the foregoing fuel return line, a pressure regulator is provided in the fuel return line. Thus, fuel pressure in the fuel pipe arrangement is automatically controlled to a value set by the pressure regulator. On the other hand, in the returnless pipe arrangement as disclosed in the foregoing U.S. Patent, since the pressure regulator is not provided, the following problem is resulted. Specifically, even if the fuel pump is stopped in response to a fuel pressure in the fuel pipe arrangement exceeding a set value, the fuel pressure continues to be higher than the set value while the fuel cut is performed or the fuel injection amount is small. Thus, the excessive fuel injection amount is resulted thereafter so that the air-fuel ratio deviates from a target value to deteriorate the driveability and the exhaust emission. As appreciated, the fuel injection amount is properly controlled based on calculated fuel injection time (injection pulse widths of signals fed to the injectors) on the assumption that the fuel pressure is held at the set value. Thus, the fuel injection amount inevitably increases if the fuel pressure is held higher than the set value.

In the foregoing U.S. Patent, a relief valve is provided in the fuel pipe arrangement for relieving an excessive pressure when the fuel pressure in the fuel pipe arrangement becomes abnormally high, so as to protect the system. However, the relief valve is operated to relieve the pressure only when the fuel pressure increases to be abnormally high. Accordingly, the relief valve is not operated upon such increment of the fuel pressure that temporarily occurs under the normal fuel injection control, such as during the foregoing fuel cut. Thus, in that event, the fuel pressure in the fuel pipe arrangement is held higher than the set value so that deviation of the air-fuel ratio from the target value is resulted.

SUMMARY OF THE INVENTION

Therefore, it is an object of the present invention to provide an improved fuel supply system for an internal combustion engine.

According to one aspect of the present invention, a fuel supply system for an internal combustion engine, the fuel supply system having a returnless fuel pipe arrangement in which no fuel return line is provided for returning an excessive portion of fuel, delivered under pressure from a fuel pump to a fuel injector, to a fuel tank, comprises fuel pressure control means for controlling a fuel discharge of the fuel pump into the fuel pipe arrangement so as to converge a fuel pressure in the fuel pipe arrangement to a target fuel pressure; a relief valve provided at a discharge side of the fuel pump in the fuel pipe arrangement so as to allow or disable communication between the fuel pipe arrangement and the fuel tank therethrough; and driving means for driving the relief valve so as to establish communication between the fuel pipe arrangement and the fuel tank when the fuel pressure in the fuel pipe arrangement becomes higher than the target fuel pressure by a predetermined value.

It may be arranged that the driving means determines that the fuel pressure in the fuel pipe arrangement becomes higher than the target fuel pressure by the predetermined value when fuel cut is performed to stop fuel injection from the fuel injector, and forcibly opens the relief valve to establish communication between the fuel pipe arrangement and the fuel tank.

According to another aspect of the present invention, a fuel supply system for an internal combustion engine, the fuel supply system having a returnless fuel pipe arrangement in which no fuel return line is provided for returning an excessive portion of fuel, delivered under pressure from a fuel pump to a fuel injector, to a fuel tank, comprises fuel pressure control means for controlling a fuel discharge of the fuel pump into the fuel pipe arrangement so as to converge a fuel pressure in the fuel pipe arrangement to a target fuel pressure; a check valve provided at a fuel discharge portion of the fuel pump; and driving means for forcibly opening the check valve when the fuel pressure in the fuel pipe arrangement becomes higher than the target fuel pressure by a predetermined value.

It may be arranged that the driving means determines that the fuel pressure in the fuel pipe arrangement becomes higher than the target fuel pressure by the predetermined value when fuel cut is performed to stop fuel injection from the fuel injector, and forcibly opens the check valve.

According to another aspect of the present invention, a fuel supply system for an internal combustion engine, the fuel supply system having a returnless fuel pipe arrangement in which no fuel return line is provided for returning an excessive portion of fuel, delivered under pressure from a fuel pump to a fuel injector, to a fuel tank, comprises fuel pressure control means for controlling a fuel discharge of the fuel pump into the fuel pipe arrangement so as to converge a fuel pressure in the fuel pipe arrangement to a target fuel pressure, the fuel pump constantly communicating with the fuel pipe arrangement; and fuel pressure lowering means for lowering the fuel pressure in the fuel pipe arrangement by reducing the fuel discharge of the fuel pump when the fuel pressure in the fuel pipe arrangement becomes higher than the target fuel pressure by a predetermined value.

It may be arranged that the fuel pressure lowering means lowers the fuel pressure in the fuel pipe arrangement by stopping the fuel pump or rotating the fuel pump in a reverse direction.

It may be arranged that the fuel pressure lowering means determines that the fuel pressure in the fuel pipe arrangement becomes higher than the target fuel pressure by the predetermined value when fuel cut is performed to stop fuel injection from the fuel injector, and lowers the fuel pressure in the fuel pipe arrangement by stopping the fuel pump or rotating the fuel pump in a reverse direction.

According to another aspect of the present invention, a fuel supply system for an internal combustion engine, the fuel supply system having a returnless fuel pipe arrangement in which no fuel return line is provided for returning an excessive portion of fuel, delivered under pressure from a fuel pump to a fuel injector, to a fuel tank, comprises fuel pressure control means for controlling a fuel discharge of the fuel pump into the fuel pipe arrangement so as to converge a fuel pressure in the fuel pipe arrangement to a target fuel pressure; and fuel pressure lowering means for lowering the fuel pressure in the fuel pipe arrangement when fuel cut is performed to stop fuel injection from the fuel injector, the fuel pressure lowering means lowering the fuel pressure in the fuel pipe arrangement so that the lowered fuel pressure approximates to the target fuel pressure.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings. Throughout the figures, the same signs or symbols represent the same or like components.

Figure 1:
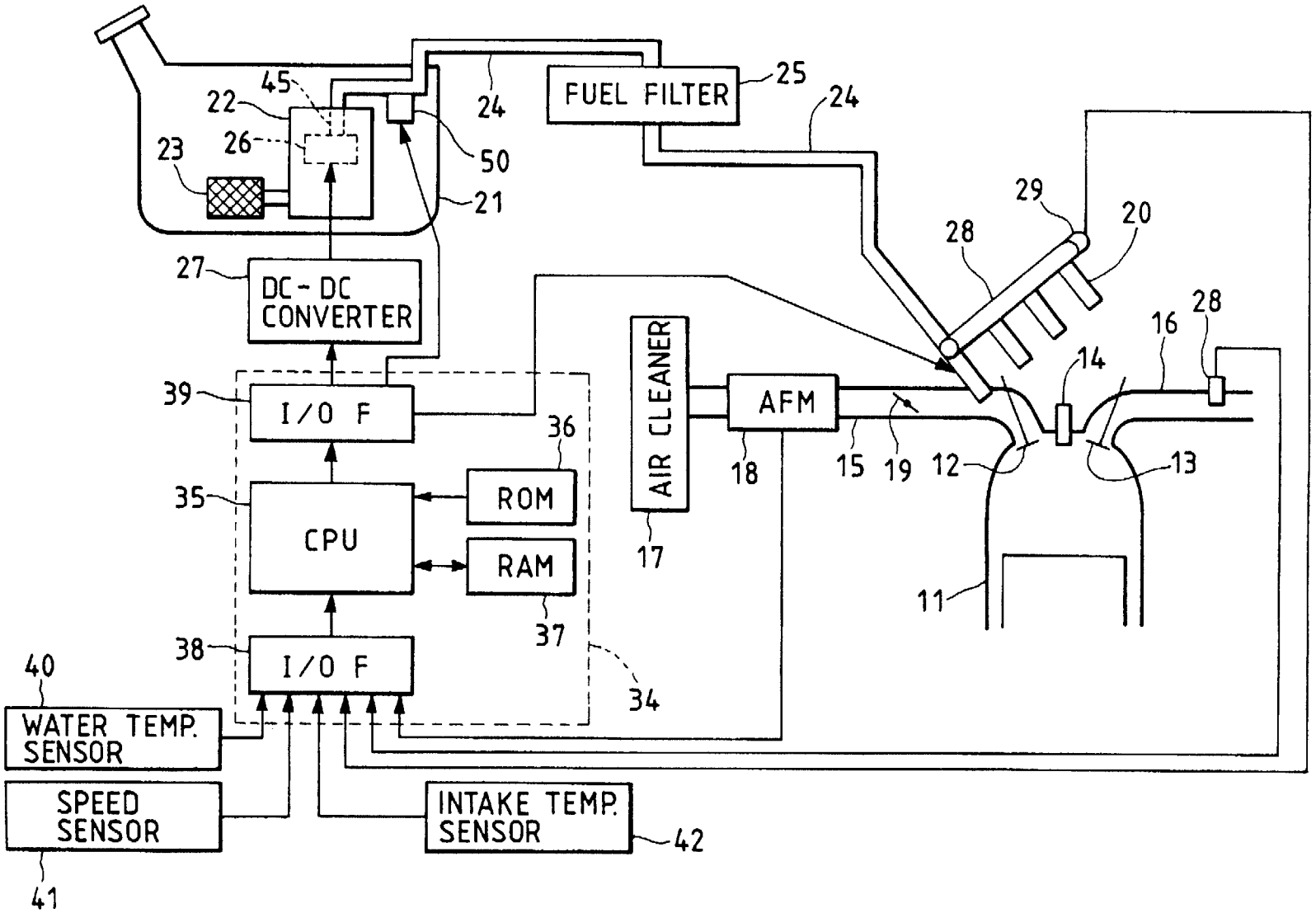
FIG. 1 is a diagram schematically showing the whole structure of a fuel supply system for an internal combustion engine according to a first preferred embodiment of the present invention.

FIG. 1 is a diagram schematically showing the whole structure of a fuel supply system for an internal combustion engine according to a first preferred embodiment of the present invention.

Between an intake pipe 15 and an exhaust pipe 16 are connected engine cylinders 11 each provided with an intake valve 12, an exhaust valve 13 and a spark plug 14. An air flow meter 18 is provided in the intake pipe 15 downstream of an air cleaner 17 for monitoring the flow rate of the air passing through the air cleaner 17. In the intake pipe 15, a throttle valve 19 and fuel injectors 20 are further arranged downstream of the air flow meter 18. On the other hand, in the exhaust pipe 16 is provided an oxygen sensor 28 for monitoring oxygen concentration in the exhaust gas. A three way catalytic converter (not shown) is further arranged downstream of the oxygen sensor 28.

In a fuel tank 21 storing the fuel, a fuel pump 22 is provided for delivering the fuel under pressure to the fuel injectors 20. A filter 23 is arranged at an inlet or suction side of the fuel pump 22. A fuel line 24 connects between a discharge port 30 (see FIG. 3) of the fuel pump 22 and a delivery pipe 28 on which the fuel injectors 20 are mounted for injecting the fuel for the corresponding engine cylinders 11. A fuel filter 25 is provided in the fuel line 24 for capturing dust in the fuel. As seen from the figure, no fuel return line is provided so that a returnless fuel pipe arrangement is formed extending from the fuel tank 21 to the fuel injectors 20.

The fuel pump 22 is driven by a variable-speed dc pump motor 26. By adjusting voltage applied to the pump motor 26 through a DC-DC converter 27, the speed of the fuel pump 22 is controlled so as to control delivery or discharge pressure of the fuel pump 22. Pressure of the fuel discharged from the fuel pump 22 (fuel pressure Pf) is monitored by a fuel pressure sensor 29 provided in the delivery pipe 28. As appreciated, the fuel pressure sensor 29 may be provided in the fuel line 24.

A control circuit 34 is mainly composed of a microcomputer having a CPU 35, a ROM 36, a RAM 37 and input/output interfaces 38 and 39. The control circuit 34 reads in data outputted from various sensors, such as a water temperature sensor 40 monitoring engine coolant temperature, a speed sensor 41 outputting pulses depending on the engine speed, an intake temperature sensor 42 monitoring intake air temperature and the air flow meter 18, and calculates the fuel injection amount and the ignition timing for outputting to the fuel injectors 20 and an igniter (not shown). The control circuit 34 further performs a feedback control of the fuel pump 22 based on an output signal, indicative of the fuel pressure Pf, from the fuel pressure sensor 29 so as to converge the fuel pressure Pf to a target fuel pressure Pft.

Figure 3:
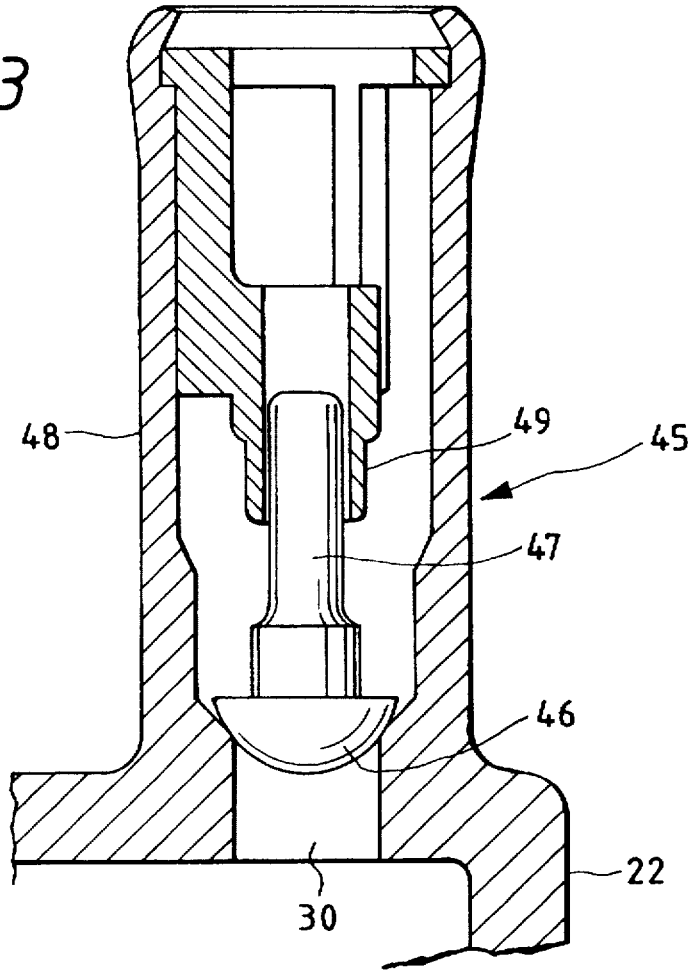
FIG. 3 is an enlarged sectional view of a check valve incorporated in the fuel supply system shown in FIG. 1.

As shown in FIG. 3, a check valve 45 is provided at the discharge port 30 of the fuel pump 22. The check valve 45 includes a valve case 48, a support sleeve 49 fixed in the valve case 48, a valve element 46 with a shaft 47 which is slidably received in the support sleeve 49, and a valve seat formed at an end of the discharge port 30 of the fuel pump 22. While the fuel pump 22 is operated, the valve element 46 is separated from the valve seat due to the discharge pressure of the fuel pump 22 and thus held at a valve-opening position to open the discharge port 30 relative to the delivery pipe 28 via the fuel line 24. On the other hand, while the fuel pump 22 is stopped, the valve element 46 is pressed onto the valve seat due to the fuel pressure in the fuel line 24 and thus held at a valve-closing position to close the discharge port 30 so that the reverse or back flow of the fuel in the fuel line 24 toward the fuel tank 21 via the fuel pump 22 is prevented to keep the fuel pressure in the fuel line 24.

Figure 2:
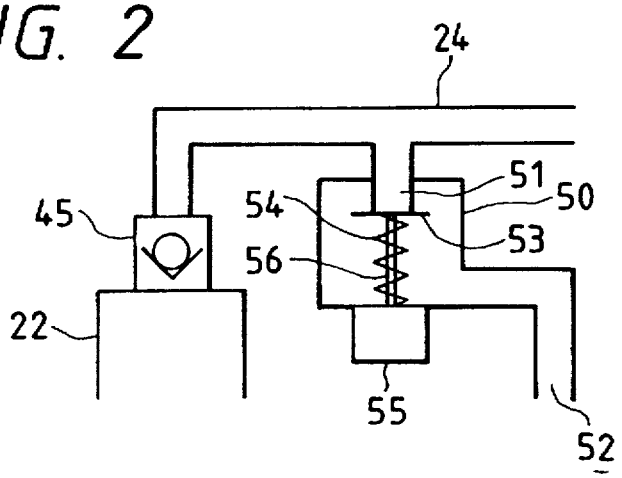
FIG. 2 is a diagram schematically showing a structure in the neighborhood of a relief valve incorporated in the fuel supply system shown in FIG. 1.

As shown in FIG. 2, a relief valve 50 is provided downstream of the check valve 45. The relief valve 50 includes an inlet port 51 communicating with the fuel line 24, an outlet port 52 opened into the fuel tank 21, a valve element 53 for opening and closing the inlet port 51 relative to the outlet port 52, and a spring 54 urging the valve element 53 toward a valve-closing direction. A biasing force of the spring 54 is so set as to open the relief valve 50, that is, to allow the valve element 53 to open the inlet port 51 relative to the outlet port 52, when the fuel pressure in the fuel line 24 becomes equal to or greater than a predetermined system protective pressure Psp.

An electromagnet 55 with a plunger 56 is further provided for forcibly opening the relief valve 50 when the fuel pressure Pf in the fuel line 24 becomes higher than the target fuel pressure Pft by a given value or when the fuel cut is performed. Specifically, the valve element 53 is coupled to the plunger 56 of the electromagnet 55. By energizing the electromagnet 55, the valve element 53 is lifted against the biasing force of the spring 54 to open the relief valve 50 for relieving the fuel pressure in the fuel line 24 toward the fuel tank 21. The electromagnet 55 is controlled to be energized and deenergized by the control circuit 34, which will be described later. Instead of the electromagnet 55, another actuator such as a motor may be used for driving the valve element 53 of the relief valve 50.

Figure 4:
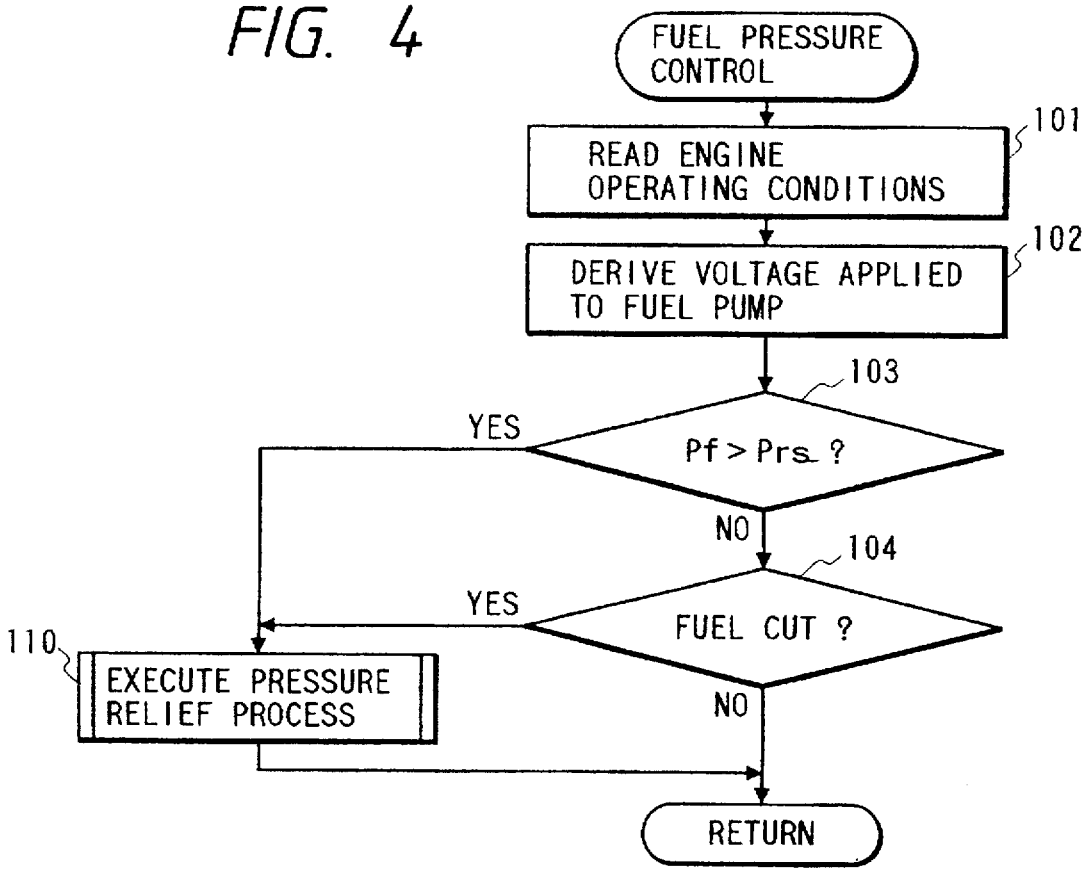
FIG. 4 is a flowchart of a fuel pressure control routine to be executed by a control circuit according to the first preferred embodiment.

FIG. 4 is a flowchart of a fuel pressure control routine to be executed by the control circuit 34. This control routine is repeatedly executed per given short period.

In FIG. 4, at first step 101, the control circuit 34 reads out data from the foregoing various sensors indicative of engine operating conditions. Subsequently, at step 102, voltage applied to the fuel pump 22 is derived based on the output signal of the fuel pressure sensor 29 so as to converge the fuel pressure Pf in the fuel line 24 to the target fuel pressure Pft.

Thereafter, step 103 determines whether a condition for relieving the fuel pressure in the fuel line 24 is established. Specifically, step 103 determines whether the fuel pressure Pf monitored by the fuel pressure sensor 29 exceeds a preset pressure relief start pressure Prs. If positive at step 103, the routine proceeds to step 110 where a pressure relief process is executed. On the other hand, if negative at step 103, the routine proceeds to step 104 where it is determined whether another condition for relieving the fuel pressure in the fuel line 24 is established. Specifically, step 104 determines whether the fuel cut is performed. If positive at step 104, the routine proceeds to step 110 where the pressure relief process is executed. On the other hand, if negative at step 104, the current cycle of this routine is terminated.

The pressure relief start pressure Prs is set lower than the system protective pressure Psp which opens the relief valve 50 and higher than the target fuel pressure Pft by the given value, that is, Pft<Prs<Psp.

Figure 5:
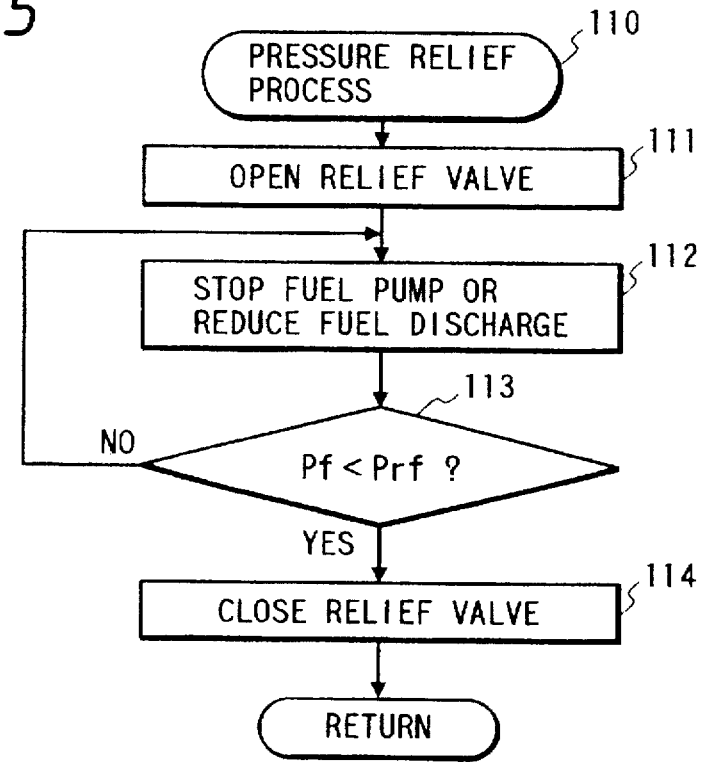
FIG. 5 is a flowchart of a subroutine for executing a pressure relief process shown in FIG. 4.

FIG. 5 is a flowchart of a subroutine for executing the pressure relief process at step 110.

In FIG. 5, at first step 111, the electromagnet 55 of the relief valve 50 is energized so as to open the relief valve 50. Thus, the fuel in the fuel line 24 escapes into the fuel tank 21 via the relief valve 50 so that the fuel pressure in the fuel line 24 is lowered. For effectively achieving the pressure relief at step 111, step 112 stops the operation of the fuel pump 22 or reduces its speed so as to stop or reduce the fuel discharge into the fuel line 24.

Thereafter, at step 113, it is determined whether the fuel pressure Pf monitored by the fuel pressure sensor 29 becomes lower than a preset pressure relief finish pressure Prf. The pressure relief finish pressure Prf is set to the target fuel pressure Pft or a pressure around Pft. The pressure relief continues to be performed until the fuel pressure Pf becomes lower than the pressure relief finish pressure Prf at step 113. When Pf<Prf at step 113, the routine proceeds to step 114 where the energization to the electromagnet 55 is stopped to close the relief valve 50 so that the pressure relief process is finished. Then, the feedback control of the fuel pump 22 is executed based on the output signal from the fuel pressure sensor 29.

Now, an operational example achieved by executing the foregoing control shown in FIGS. 4 and 5 will be explained with reference to a time chart shown in FIG. 6.

When the throttle valve 19 is fully closed to turn on an idle switch (not shown), the fuel cut is performed so that the fuel injection from the fuel injectors 20 is stopped. As seen in FIG. 6, when the throttle valve 19 is fully closed, the fuel pressure Pf increases due to rapid reduction in fuel injection amount. On the other hand, when the fuel cut is started, the relief valve 50 is simultaneously opened so that the fuel in the fuel line 24 escapes into the fuel tank 21 via the relief valve 50 to reduce the fuel pressure Pf. When the fuel pressure Pf is lowered to the pressure relief finish pressure Prf near the target fuel pressure Pft, the relief valve 50 is closed so as to maintain the fuel pressure Pf substantially at the target fuel pressure Pft.

Figure 6:
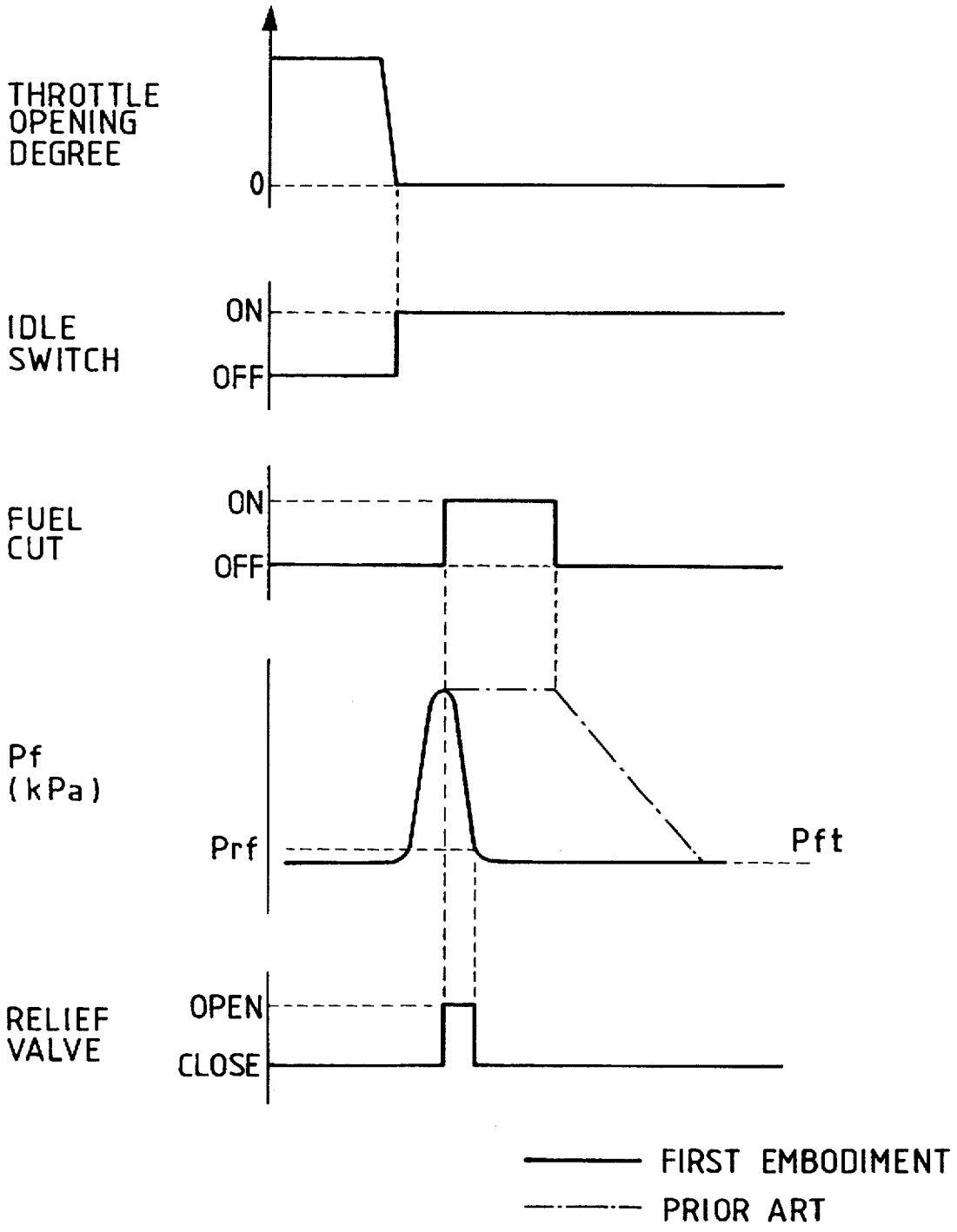
FIG. 6 is a time chart for explaining a time-domain variation of fuel pressure when the pressure relief process is executed.

On the contrary, in the aforementioned prior art, since no means is provided for relieving the fuel in the fuel line during the fuel cut, the fuel pressure in the fuel line is held, during the fuel cut, at high pressure immediately before the start of the fuel cut as shown by the alternate long and short dash line in FIG. 6. Accordingly, the fuel pressure after the fuel cut becomes higher than the target fuel pressure by several kPa to several tens of kPa. Thus, the fuel injection amount after the fuel cut increases to cause deviation of the air-fuel ratio so that the driveability and the exhaust emission are deteriorated.

On the other hand, in the foregoing first preferred embodiment, since the fuel pressure can be lowered to the pressure near the target fuel pressure by opening the relief valve 50 during the fuel cut, the fuel injection amount after the fuel cut can be properly controlled. Thus, the deviation of the air-fuel ratio is not caused so that deterioration of the driveability and the exhaust emission is effectively prevented.

Although not shown in FIG. 6, in the foregoing first preferred embodiment, the pressure relief is also performed when the fuel pressure Pf exceeds the pressure relief start pressure Prs. Thus, the fuel pressure Pf is quickly lowered to the pressure near the target fuel pressure Pft so that the deviation of the air-fuel ratio is prevented.

In the first preferred embodiment, even if failure occurs to the electromagnet 55 so that the relief valve 50 can not be opened by means of the electromagnet 55, the relief valve 50 still can be opened when the fuel pressure Pf becomes equal to or greater than the system protective pressure Psp so as to lift the valve element 53 against the biasing force of the spring 54. Thus, even if failure occurs to the electromagnet 55, the system protection is achieved against the abnormal increment of the fuel pressure.

In the first preferred embodiment, the relief valve 50 is arranged to open when the pressure relieving condition is established at step 103 or 104 in FIG. 4 or when the fuel pressure becomes equal to or greater than the system protective pressure Psp. Thus, the structure of the system can be simplified and less costly as compared with a case where two relief valves are provided for achieving the functions of the relief valve 50. On the other hand, the present invention covers the structure in which the two relief valves are provided instead of the relief valve 50.

Figure 7:
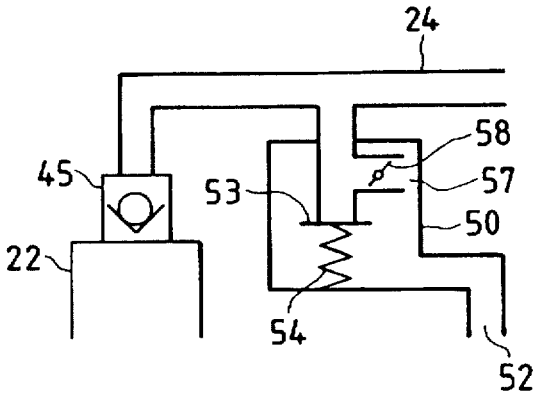
FIG. 7 is a diagram showing a modification of the relief valve.

FIG. 7 shows a modification of the relief valve 50. In FIG. 7, a branch inlet 57 is provided at the inlet port 51 of the relief valve 50, and a pressure relief valve 58 is disposed in the branch inlet 57. The pressure relief valve 58 is arranged to be driven by driving means such as a motor (not shown). When the fuel pressure Pf exceeds the pressure relief start pressure Prs or when the fuel cut is performed, the pressure relief valve 58 is opened so that the fuel in the fuel line 24 escapes into the fuel tank 21 via the pressure relief valve 58 to lower the fuel pressure Pf.

Figure 8:
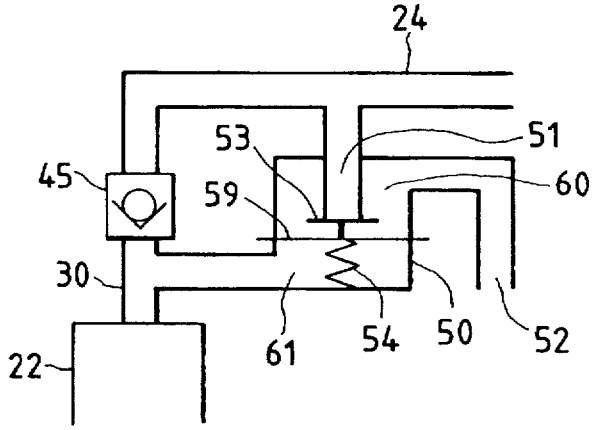
FIG. 8 is a diagram showing another modification of the relief valve.

FIG. 8 shows another modification of the relief valve 50. In FIG. 8, the inside of the relief valve 50 is divided into two chambers 60 and 61 by means of a diaphragm 59. When the valve element 53 is lifted, the chamber 60 works as a fuel passage from the inlet port 51 to the outlet port 52. On the other hand, the chamber 61 communicates with a portion between the discharge port 30 of the fuel pump 22 and the check valve 45. When the fuel pressure Pf exceeds the pressure relief start pressure Prs or when the fuel cut is performed, the fuel pump 22 is rotated in a reverse direction so as to provide vacuum in the chamber 61. Thus, the diaphragm 59 is displaced downward against the biasing force of the spring 54 so as to lift the valve element 53 to open the relief valve 50. Accordingly, the fuel in the fuel line 24 escapes into the fuel tank to lower the fuel pressure. In this case, the fuel pump 22 works as driving means for operating the relief valve 50.

Figure 9:
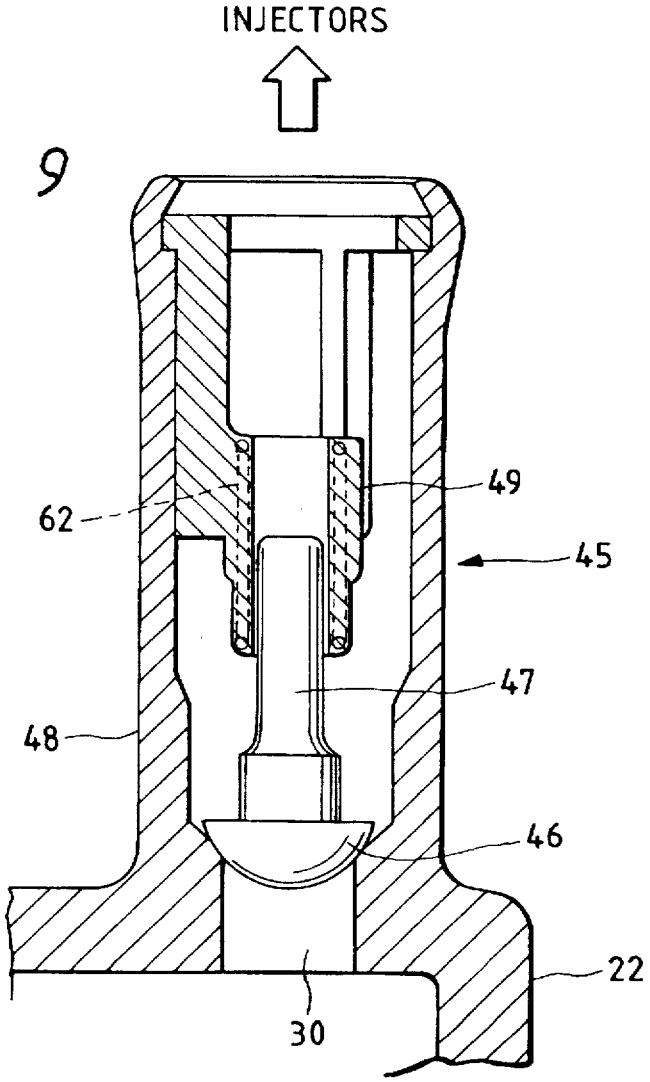
FIG. 9 is an enlarged sectional view of a check valve according to a second preferred embodiment of the present invention.
Figure 10:
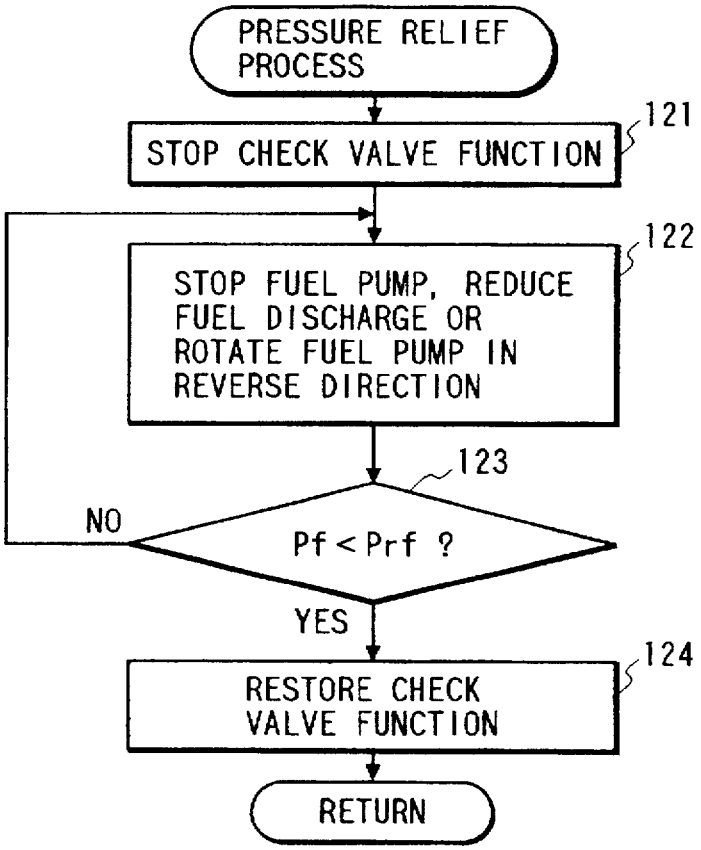
FIG. 10 is a flowchart of a subroutine for executing a pressure relief process according to the second preferred embodiment.

FIGS. 9 and 10 show a second preferred embodiment of the present invention.

In the second preferred embodiment, a solenoid 62 is arranged in the support sleeve 49 of the check valve 45. By energizing the solenoid 62, the shaft 47, made of a magnetic material, of the valve element 46 is attracted so that the valve element 46 is moved to a valve-opening position.

In the second preferred embodiment, when the fuel pressure Pf exceeds the pressure relief start pressure Prs (step 103 in FIG. 4) or when the fuel cut is performed (step 104 in FIG. 4), the pressure relieving condition is established so that a pressure relief process is executed as shown in FIG. 10. In FIG. 10, at first step 121, the solenoid 62 is energized to lift the valve element 46 so that a check valve function of the check valve 45 is stopped. Thus, the fuel in the fuel line 24 flows back into the fuel pump 22 via the check valve 45 so that the fuel pressure is lowered. For effectively achieving the pressure relief at step 121, step 122 stops the operation of the fuel pump 22, reduces the speed (fuel discharge) of the fuel pump 22 or rotates the fuel pump 22 in a reverse direction.

Thereafter, at step 123, it is determined whether the fuel pressure Pf monitored by the fuel pressure sensor 29 becomes lower than the pressure relief finish pressure Prf (target fuel pressure Pft or pressure around Pft). The pressure relief continues to be performed until the fuel pressure Pf becomes lower than the pressure relief finish pressure Prf at step 123. When Pf<Prf at step 123, the routine proceeds to step 124 where the energization to the solenoid 62 is stopped to close the check valve 45 so that the pressure relief process is finished.

As appreciated, the second preferred embodiment can achieve the effect similar to that achieved in the foregoing first preferred embodiment.

Figure 11:
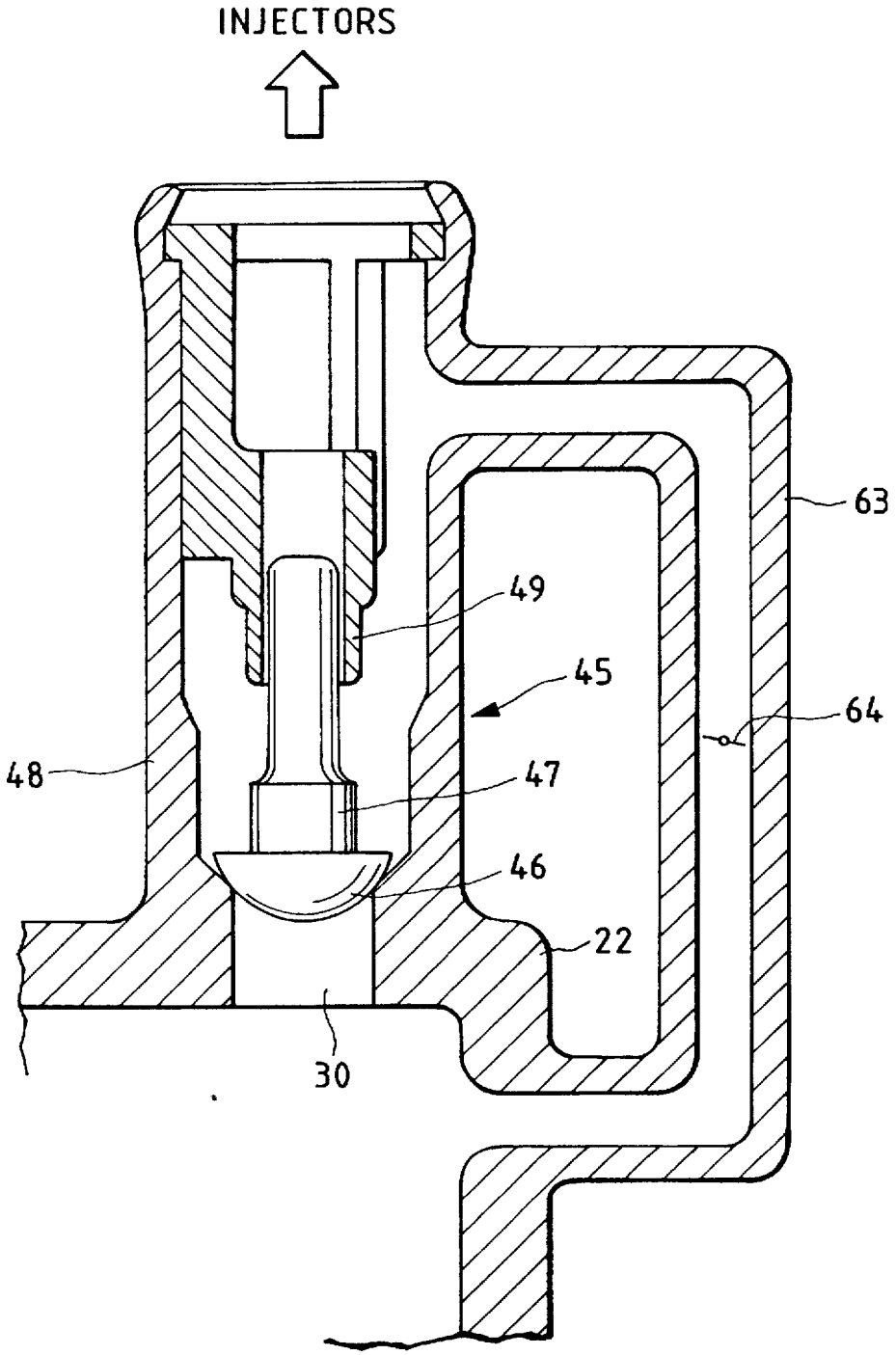
FIG. 11 is a diagram showing a modification of the check valve shown in FIG. 9.

FIG. 11 shows a modification of the check valve 45 of the second preferred embodiment. In FIG. 11, a bypass passage 63 is provided between the check valve 45 and the fuel pump 22 so as to bypass the valve element 46, and a pressure relief valve 64 is provided in the bypass passage 63. The pressure relief valve 64 is arranged to be driven by driving means such as a motor (not shown). When the fuel pressure Pf exceeds the pressure relief start pressure Prs or when the fuel cut is performed, the pressure relief valve 64 is opened so that the fuel in the fuel line 24 escapes into the fuel tank 21 via the bypass passage 63 to lower the fuel pressure. In this modification, the solenoid 62 for driving the valve element 46 of the check valve 45 is not required.

Figure 12:
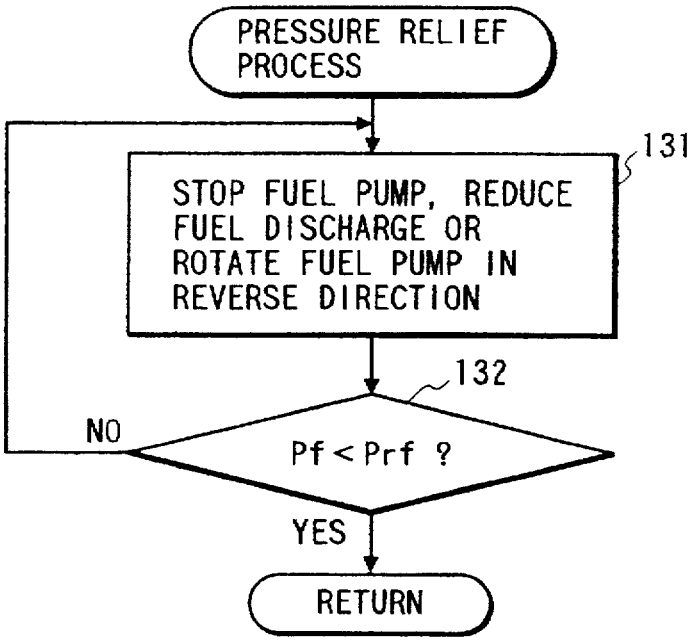
FIG. 12 is a flowchart of a subroutine for executing a pressure relief process according to a third preferred embodiment of the present invention.

FIG. 12 shows a third preferred embodiment of the present invention.

In the third preferred embodiment, the check valve 45 is omitted. Since the check valve 45 is not provided, when the discharge pressure of the fuel pump 22 becomes lower than the fuel pressure in the fuel line 24, the fuel in the fuel line 24 flows back into the fuel pump 22 so as to be returned into the fuel tank 21. Thus, in the third preferred embodiment, when the pressure relieving condition is established (step 103 or 104 in FIG. 4), step 131 stops the operation of the fuel pump 22, reduces the speed (fuel discharge) of the fuel pump 22 or rotates the fuel pump 22 in a reverse direction so as to cause the pressure at the side of the fuel pump 22 to be lower than the fuel pressure in the fuel line 24. Accordingly, the fuel in the fuel line 24 flows back into the fuel tank 21 so that the fuel pressure in the fuel line 24 is lowered.

Thereafter, at step 132, it is determined whether the fuel pressure Pf monitored by the fuel pressure sensor 29 becomes lower than the pressure relief finish pressure Prf (target fuel pressure Pft or pressure around Pft). The pressure relief continues to be performed until the fuel pressure Pf becomes lower than the pressure relief finish pressure Prf at step 132. When Pf<Prf at step 132, the pressure relief process is finished so that the normal feedback control of the fuel pump 22 is performed.

As appreciated, the check valve 45 may be omitted in the foregoing first preferred embodiment. In this case, when the pressure relieving condition is established, the fuel pump 22 may be rotated in a reverse direction in addition to opening the relieve valve 50.

In each of the foregoing preferred embodiments, steps 103 and 104 are included in the fuel pressure control routine shown in FIG. 4. However, one of them may be omitted.

In each of the foregoing preferred embodiments, the fuel pressure Pf is detected in terms of a gauge pressure (differential pressure relative to atmospheric pressure) using the fuel pressure sensor 29. On the other hand, it may be arranged to derive a differential pressure between the fuel pressure Pf and the intake manifold pressure using a differential pressure sensor. Further, in each of the foregoing preferred embodiments, voltage applied to the pump motor 26 of the fuel pump 22 is adjusted through the DC-DC converter 27. On the other hand, it may be arranged that voltage applied to the pump motor 26 is adjusted through a PWM control so as to control the speed of the fuel pump 22.

While the present invention has been described in terms of the preferred embodiments, the invention is not to be limited thereto, but can be embodied in various ways without departing from the principle of the invention as defined in the appended claims.

What is claimed is:

1. A fuel supply system for an internal combustion engine, and fuel supply system having a returnless fuel pipe arrangement in which no fuel return line is provided for returning an excessive portion of fuel, delivered under pressure from a fuel pump to a fuel injector, to a fuel tank, said fuel supply system comprising:

fuel pressure control means for controlling said fuel pump so as to converge a fuel pressure in said fuel pipe arrangement to a target fuel pressure;

a check valve provided at a fuel discharge port of said fuel pump; and function stopping means for stopping a function of said check valve under a predetermined condition.

2. The fuel supply system according to claim 1, wherein said fuel pressure control means includes means for reducing a fuel discharge of said fuel pump under said predetermined condition.

3. The fuel supply system according to claim 1, wherein said fuel pressure control means stops said fuel pump under said predetermined condition.

4. The fuel supply system according to claim 1, wherein said fuel pressure control means rotates said fuel pump in a reverse direction under said predetermined condition.

5. The fuel supply system according to claim 1, wherein said check valve includes a solenoid, and said function stopping means stops the function of said check valve by energizing said solenoid.

6. The fuel supply system according to claim 1, wherein said function stopping means stops the function of said check valve when the fuel pressure in said fuel pipe arrangement becomes higher than the target fuel pressure by a predetermined value.

7. The fuel supply system according to claim 1, wherein said function stopping means stops the function of said check valve when fuel cut is performed to stop fuel injection from said fuel injector.

8. The fuel supply system according to claim 7, wherein said fuel pressure control means includes means for controlling, during the fuel cut, the fuel pressure in said fuel pipe arrangement to approximate to a value which represents the target fuel pressure for fuel injection upon returning from the fuel cut.

* * * * *